US006259465B1

(12) United States Patent
Tutt et al.

(10) Patent No.: US 6,259,465 B1
(45) Date of Patent: Jul. 10, 2001

(54) LASER THERMAL MEDIA WITH IMPROVED ABRASION RESISTANCE

(75) Inventors: Lee W. Tutt; James P. Heetderks, both of Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/189,544

(22) Filed: Nov. 11, 1998

(51) Int. Cl.[7] ..... B41J 2/435
(52) U.S. Cl. ..... 347/224
(58) Field of Search ..... 347/224, 113; 399/159, 45; 430/201, 269

(56) References Cited

U.S. PATENT DOCUMENTS 3,692,404 * 9/1972 Lester et al. ..... 346/113
5,121,343 * 6/1992 Faris ..... 250/558
5,300,398 4/1994 Kaszczuk ..... 430/200
5,429,909 7/1995 Kaszczuk et al. ..... 430/273
5,459,017 * 10/1995 Topel, Jr. et al. ..... 430/269
5,828,931 * 10/1998 May et al. ..... 399/159
5,858,607 * 1/1999 Burberry et al. ..... 430/201
5,966,559 * 10/1999 May et al. ..... 399/45

* cited by examiner

*Primary Examiner*—N. Le
*Assistant Examiner*—K. Feggins
(74) *Attorney, Agent, or Firm*—Harold E. Cole

(57) ABSTRACT

A laser ablative recording element with a support having a certain Young's modulus and having thereon an image layer comprising an image dye or pigment dispersed in a polymeric binder, the image layer having a near infrared-absorbing material associated therewith to absorb at a given wavelength of the laser used to expose the element, the image dye or pigment absorbing in the region of from about 250 to about 700 nm, the element having a compliant layer between the support and the image layer, the compliant layer having a Young's modulus lower than that of the support, and the compliant layer having a thickness of between about 2 $\mu$m and about 200 $\mu$m.

14 Claims, No Drawings

LASER THERMAL MEDIA WITH IMPROVED ABRASION RESISTANCE

FIELD OF THE INVENTION

This invention relates to a laser thermal imaging media, and more particularly to a media which has improved abrasion resistance.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element.

The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271,the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off the image dye and binder at the spot where the laser beam hits the element. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer.

Usefulness of such an ablative element is largely determined by the efficiency at which the imaging dye can be removed on laser exposure. The transmission Dmin value is a quantitative measure of dye clean-out: the lower its value at the recording spot, the more complete is the attained dye removal.

There is a problem with the scratch and abrasion resistance of such an ablative element. One way to improve it is to use lamination. However, lamination is expensive and air pockets may be trapped during the laminating step causing image defects.

Another way to improve abrasion resistance is to apply a liquid overcoat. However, this method requires the handling of liquids and the use of environmentally undesirable solvents.

This invention overcomes the aforementioned problems and provides a novel approach to obtain a more abrasion resistant single sheet ablation material.

DESCRIPTION OF RELATED ART

U.S. Pat. No. 5,429,909 describes the use of an overcoat layer on a laser ablative element. However, there is a problem with this approach in that more power is required to remove the added protective overcoat layer.

U.S. Pat. No. 5,300,398 relates to the use of a cushion layer for use in a two sheet process for producing a laser transfer image. The cushion layer is on an intermediate sheet to which the dye is first transferred. This intermediate sheet is then used to transfer the dye image to a final receiver and the cushion layer was found to improve gloss control. However, a two-sheet process is inherently more complicated and expensive than a one-sheet process.

It is an object of this invention to provide a single sheet ablation element which has an improved abrasion and scratch resistance. It is another object of this invention to provide a method for producing an ablation image which can significantly reduce its susceptibility to scratches and abrasion while not requiring a post-processing step. It is still another object of the invention to provide an ablation element which has improved abrasion and scratch resistance while having little impact on its speed and efficiency.

SUMMARY OF THE INVENTION

These and other objects are achieved in accordance with the invention which relates to a laser ablative recording element comprising a support having a certain Young's modulus and having thereon an image layer comprising an image dye or pigment dispersed in a polymeric binder, the image layer having a near infrared-absorbing material associated therewith to absorb at a given wavelength of the laser used to expose the element, the image dye or pigment absorbing in the region of from about 250 to about 700 nm, the element having a compliant layer between the support and the image layer, the compliant layer having a Young's modulus lower than that of the support, and the compliant layer having a thickness of between about 2 $\mu$m and about 200 $\mu$m.

Another embodiment of the invention relates to a process of forming a single color, ablation image having improved abrasion resistance comprising:

a) imagewise-heating, by means of a laser, an ablative recording element comprising a support having a certain Young's modulus and having thereon an image layer, the imagewise-heating causing the image layer to ablate imagewise, the image layer comprising an image dye or pigment dispersed in a polymeric binder, the image layer having a near infrared-absorbing material associated therewith to absorb at a given wavelength of the laser used to expose the element, the image dye or pigment absorbing in the region of from about 250 to about 700 nm, the element having a compliant layer between the support and the image layer, the compliant layer having a Young's modulus lower than that of the support, and the compliant layer having a thickness of between about 2 μm and about 200 μm; and b) removing the ablated material to obtain an image in the ablative recording element.

Use of the invention provides an element with an improved abrasion and scratch resistance without sacrificing speed or efficiency since the layer which provides the improvement is underneath the image layer and not on top like other methods.

DETAILED DESCRIPTION OF THE INVENTION

Compliant layers useful in the invention can be virtually any polymer as long as it has the Young's modulus relationship with the support as described above. For example, there can be used silicones, polyolefins, polyacrylates, polymethacrylates, polyimides, polybutylenes, polyesters, etc. In particular, the following materials can be used with a support having a Young's modulus of 2.6 Gigapascals (Gpa) such as poly(ethylene terephthalate):

Polymer A A 80/20 mixture of low density (branched) and high density polyethylene which can be hot melt extruded onto a support (0.1 Gpa)

Polymer B A linear polyester derived from terephthalic acid, ethylene glycol, and 4,4'-bis(2-hydroxyethyl) bisphenol-A (50 mole % ethylene glycol) (0.65 Gpa)

Polymer C Carboset ® XPD-2136 (BF Goodrich Co.), a water dispersed polyacrylate copolymer at a solids level of 50% (0.2 Gpa)

Generally speaking, the compliant layer should not absorb the dyes which are subsequently coated. Thus either the coating solvent for the dye layer should not dissolve or imbibe the dyes into the compliant layer or a barrier layer should be present to minimize intermixing.

In a preferred embodiment of the invention, the ablative recording element contains a barrier layer between the support and the image layer, such as those described and claimed in U.S. Pat. No. 5,459,017 and 5,468,591, the disclosures of which are hereby incorporated by reference.

In another preferred embodiment, a thin top layer containing particles may also be employed which further improves scratch resistance.

Use of this invention improves the scratch-resistance and abrasion-resistance of the element. This is important, for example, in reprographic mask and printing mask applications where a scratch can remove fine line detail creating a defect in all subsequently exposed work. The resulting single-sheet medium can be used for creating medical images, reprographic masks, printing masks, etc., or it can be used in any application where a monocolored transmission sheet is desired. The image obtained can be positive or negative.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

In a preferred embodiment of the invention, the image dye or pigment in the ablative recording element is substantially transparent in the near infrared region of the electromagnetic spectrum (700 to 1100 nm) and absorbs in the region of from about 250 to about 700 nm and does not have substantial absorption at the wavelength of the laser used to expose the element. Generally, the image dye or pigment is a different material from the infrared-absorbing material used in the element to absorb the infrared radiation and provides visible and/or UV contrast at wavelengths other than the laser recording wavelengths. However, a pigment such as carbon could be used and would act as both the image pigment and near infrared-absorber. Thus, one material would perform two functions.

Any polymeric material may be used as the binder in the recording element employed in the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); polystyrene; poly (styrene-co-acrylonitrile); a polysulfone; a poly(phenylene oxide); a poly(ethylene oxide); a poly(vinyl alcohol-co-acetal) such as poly(vinyl acetal), polycyanoacrylate, poly (vinyl alcohol-co-butyral) or poly(vinyl benzal); or mixtures or copolymers thereof. The binder may be used at a coverage of from about 0.1 to about 5 $g/m^2$. In a preferred embodiment, the polymeric binder used in the recording element of the invention is nitrocellulose.

To obtain a laser-induced, ablative image using the invention, a diode laser is preferably employed since it offers substantial advantages in terms of its small size, low cost, stability, reliability, ruggedness, and ease of modulation. In practice, before any laser can be used to heat an ablative recording element, the element must contain a near infrared-absorbing material, such as pigments like carbon black, metals such as aluminum, or cyanine infrared-absorbing dyes as described in U.S. Pat. No. 4,973,572,or other materials as described in the following U.S. Pat. Nos.: 4,948,777; 4,950,640; 4,950,639; 4,948,776; 4,948,778; 4,942,141; 4,952,552; 5,036,040 and 4,912,083, the disclosures of which are hereby incorporated by reference. The laser radiation is then absorbed into the image layer containing a dye or pigment and converted to heat by a molecular process known as internal conversion. Thus, the construction of a useful image layer will depend not only on the hue, transferability and intensity of the dye or pigment, but also on the ability of the image layer to absorb the radiation and convert it to heat. The near infrared-absorbing material or dye may be contained in the image layer itself or in a separate layer associated therewith, i.e., above or below the image layer. In a preferred embodiment of the invention, the laser exposure takes place on or through the image layer side of the ablative recording element, which enables this process to be a single-sheet process, i.e., no separate receiving element is required.

Lasers which can be used in the invention are available commercially. There can be employed, for example, Laser Model SDL-2420-H2 from Spectra Diode Labs, or Laser Model SLD 304 V/W from Sony Corp.

Any image dye can be used in the ablative recording element of the invention provided it can be ablated by the action of the laser. Especially good results have been obtained with dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

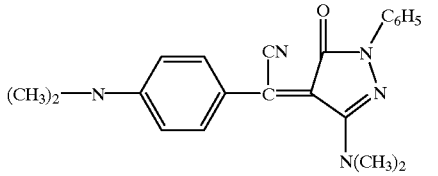

(magenta)

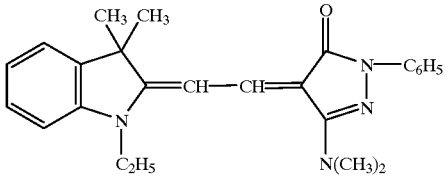

(yellow)

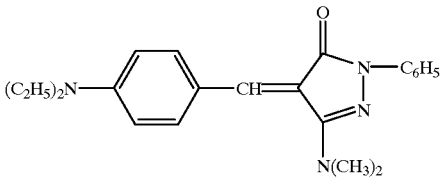

(yellow)

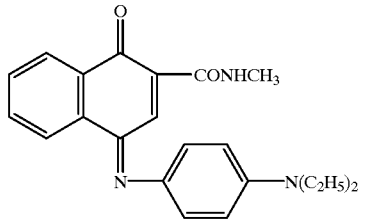

(cyan)

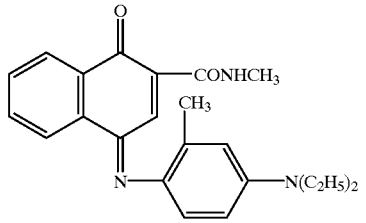

(cyan)

or any of the dyes disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Pigments which can be used in the image layer include inorganic pigments such as carbon black or graphite. Examples of organic pigments which can be used in the invention include metal phthalocyanines such as copper phthalocyanine, quinacridones, epindolidiones, Rubine F6B (C.I. No. Pigment 184); Cromophthal.RTM. Yellow 3G (C.I. No. Pigment Yellow 93); Hostaperm.RTM. Yellow 3G (C.I. No. Pigment Yellow 154); Monastral.RTM. Violet R (C.I. No. Pigment Violet 19); 2,9-dimethylquinacridone (C.I. No. Pigment Red 122); Indofast.RTM. Brilliant Scarlet R6300 (C.I. No. Pigment Red 123); Quindo Magenta RV 6803; Monstral.RTM. Blue G (C.I. No. Pigment Blue 15); Monstral.RTM. Blue BT 383D (C.I. No. Pigment Blue 15); Monstral.RTM. Blue G BT 284D (C.I. No. Pigment Blue 15); Monstral.RTM. Green GT 751D (C.I. No. Pigment Green 7) or any of the materials disclosed in U.S. Pat. Nos. 5,171,650 or 5,516,622, the disclosures of which are hereby incorporated by reference. Combinations of pigments and/or dyes can also be used. The pigments may be employed at a coverage of from about 0.05 to about 5 g/m$^2$.

The image layer of the ablative recording element of the invention may be coated on the support or printed thereon by a printing technique such as a gravure process.

Any material can be used as the support for the ablative recording element of the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 500 $\mu$m. In a preferred embodiment, the support is transparent.

The following examples are provided to illustrate the invention.

EXAMPLES

Young's modulus

The Young's modulus of each of the polymers was measured by placing a piece of film 1.5 cm wide by 2.5 cm long between clamps on an MTS/Sintech Model 4204 Tensile testing machine and stretching the sample. The force versus distance was measured to give the modulus. During stretching, the material Polymer B did not break even upon stretching by more than 5X. The following results were obtained:

| Material Tested | Young's modulus (Gpa) |
|---|---|
| Poly(ethylene terephthalate) | 2.6 |
| Polymer A* | 0.1 |
| Polymer B | 0.65 |
| Polymer C | 0.2 |

*Polymer A's Young's modulus is from U.S. Pat. No. 4,734,397 (Compound 9 and Control 9)

The following materials were used in the examples:

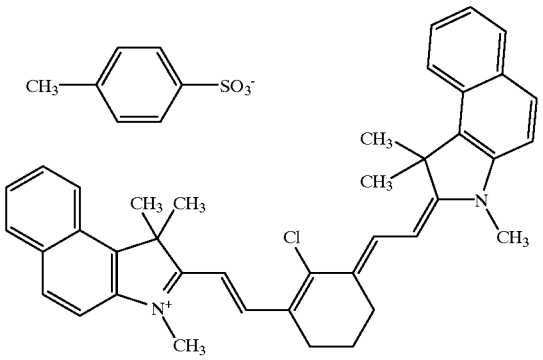

Infrared-Absorbing Dye

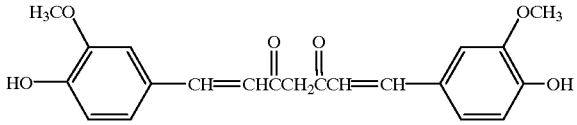

Yellow Dye 1: Curcumin

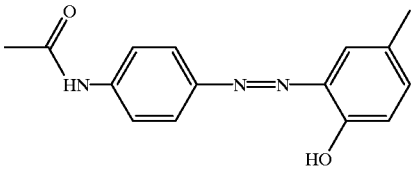

Yellow Dye 2: Keyplast Yellow GC

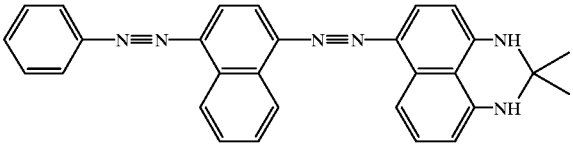

Cyan Dye: Sudan Black B

Example 1

Onto a 100 $\mu$m poly(ethylene terephthalate) support was coated a compliant layer of Polymer B. Onto this layer was coated the following layers in this order:

Subbing (barrier) layer:

| Component | Laydown (g/m$^2$) |
|---|---|
| Polycyanoacrylate, methyl:ethyl 70/30 wt. Ratio | 0.38 |
| Infrared absorbing dye | 0.05 |
| FC-431 ® surfactant (3M Co.) | 0.005 |

Dye Layer:

| Component | Laydown (g/m$^2$) |
|---|---|
| Nitrocellulose 1500 sec. (Hercules Inc.) | 0.42 |
| Yellow Dye 1 | 0.13 |
| Cyan Dye | 0.24 |
| Yellow Dye 2 | 0.34 |
| Infrared-Absorbing Dye | 0.17 |

Top Particle Layer:

| Component | Laydown (g/m$^2$) |
|---|---|
| A 60:40 copolymer of ethyl Methacrylate and methacrylic acid | 0.11 |
| Hydrocerf ® 9174 fluoropolymer particles, 2–4 $\mu$m (Shamrock Technologies Inc.) | 0.27 |
| Fluon ® AD-1 fluoropolymer particles, 0.5 $\mu$m (ICI Inc.) | 0.54 |
| Zonyl ® FSN fluorocarbon surfactant (DuPont Corp) | 0.01 |

Scratch Test:

A sample of coated media was tested using a Taber test which consists of placing a small rotating abrasive disk on the surface of the film. A 125 g of weight was applied and 50 cycles were conducted. The Taber instrument spins the weighted abrasive disk and rotates it in a circle around the film creating a ring of abraded film. The UV density of the abraded regions was measured on an X-Rite (Model 361 T) UV densitometer (X-Rite Inc.). Four measurements at different locations were averaged in both the abraded and the Dmax (unabraded) regions. The results are shown in Table 1.

TABLE 1

| Compliant Layer ($g/m^2$) | UV Dmax | UV Dmax after Taber Abrasion Test | % Density loss |
|---|---|---|---|
| Polymer B ($2.2\ g/m^2$) | 3.6 | 2.1 | 42 |
| None (control) | 3.9 | 1.99 | 49 |

The above results show that use of a compliant layer in accordance with the invention provided improved abrasion resistance as shown by the reduced density loss.

Printing The above element was ablation written using a laser diode print head, where each laser beam has a wavelength range of 830–840 nm and a nominal power output of 600 mW at the film plane. The lasers were individually turned on and off to yield an image.

The drum, 53 cm in circumference, was rotated at varying speeds and the image electronics were activated to provide adequate exposure. The translation stage was incrementally advanced across the ablation element by means of a lead screw turned by a microstepping motor, to give a center-to-center line distance of 10.58 $\mu$m (94,500 lines per meter or 2400 lines per inch). An air stream was blown over the ablation element surface to remove the ablated dye. The ablated dye and other effluents were collected by suction. The measured total power at the focal plane was 600 mW per channel maximum.

The measured Dmax optical density before printing was 3 and the measured Dmin after printing was 0.1, thus showing that the compliant layer did not have a major impact on the printing.

Example 2

In this experiment, different laydowns of polymer A were hot melt extruded onto a 100 $\mu$m poly(ethylene terephthalate) support and the barrier layer, imaging layer, and top particle layer of Example 1 were applied. The abrasion test was conducted as in Example 1. The following results were obtained:

TABLE 2

| Compliant Layer (thickness) | UV Dmax | UV Dmax after Taber Abrasion Test | % Density loss |
|---|---|---|---|
| Control | 3.57 | 1.58 | 56% |
| 12.5 $\mu$m | 3.57 | 2.48 | 30% |
| 25 $\mu$m | 3.61 | 2.94 | 18% |
| 50 $\mu$m | 3.59 | 2.58 | 28% |

The above results show that use of a compliant layer in accordance with the invention provided improved abrasion resistance as shown by the reduced density loss.

Example 3

This example is the same as Example 1 except for using a water coatable compliant layer, Polymer C, instead of Polymer B. The coating levels are given in Table 3. The following results were obtained:

TABLE 3

| Compliant Layer ($g/m^2$) | UV Dmax | UV Dmax after Taber Abrasion Test | % Density loss |
|---|---|---|---|
| None | 3.35 | 1.99 | 41% |
| Polymer C (1.08) | 3.27 | 2.34 | 28% |
| Polymer C (2.15) | 3.00 | 2.46 | 18% |
| Polymer C (4.31) | 2.99 | 2.66 | 10% |

The above results show that use of a compliant layer in accordance with the invention provided improved abrasion resistance as shown by the reduced density loss.

The invention has been described in detail with particular reference to preferred embodiments thereof, but it will be understood that variations and modifications can be effected within the spirit and scope of the invention.

What is claimed is:

1. A laser ablative recording element comprising a support having a certain Young's modulus and having thereon an image layer comprising an image dye or pigment dispersed in a polymeric binder, said image layer having a near infrared-absorbing material associated therewith to absorb at a given wavelength of the laser used to expose said element, said image dye or pigment absorbing in the region of from about 250 to about 700 nm, said element having a compliant layer between said support and said image layer, said compliant layer having a Young's modulus lower than that of said support, and said compliant layer having a thickness of between about 2 $\mu$m and about 200 $\mu$m.

2. The element of claim 1 wherein said infrared-absorbing material is a dye which is contained in said image layer.

3. The element of claim 1 wherein said support is transparent.

4. The element of claim 1 wherein a barrier layer is present between said compliant layer and said image layer.

5. The element of claim 1 wherein a particle layer is present on top of said image layer.

6. The element of claim 1 wherein said compliant layer is a polyacrylate copolymer.

7. The element of claim 1 wherein said compliant layer is a polyethylene.

8. A process of forming a single color, ablation image having improved abrasion resistance comprising:

a) imagewise-heating, by means of a laser, an ablative recording element comprising a support having a certain Young's modulus and having thereon an image layer, said imagewise-heating causing said image layer to ablate imagewise, said image layer comprising an image dye or pigment dispersed in a polymeric binder, said image layer having a near infrared-absorbing material associated therewith to absorb at a given wavelength of the laser used to expose said element, said image dye or pigment absorbing in the region of from about 250 to about 700 nm, said element having a compliant layer between said support and said image layer, said compliant layer having a Young's modulus lower than that of said support, and said compliant layer having a thickness of between about 2 $\mu$m and about 200 $\mu$m; and b) removing said ablated material to obtain an image in said ablative recording element.

9. The process of claim 8 wherein said infrared-absorbing material is a dye which is contained in said image layer.

10. The process of claim 8 wherein said support is transparent.

11. The process of claim 8 wherein a barrier layer is present between said compliant layer and said image layer.

12. The process of claim 8 wherein a particle layer is present on top of said image layer.

13. The process of claim 8 wherein said compliant layer is a polyacrylate copolymer.

14. The process of claim 8 wherein said compliant layer is a polyethylene.

* * * * *